US008444850B2

(12) United States Patent
Ho et al.

(10) Patent No.: US 8,444,850 B2
(45) Date of Patent: May 21, 2013

(54) OPERATING METHOD FOR HYDRODENITROGENATION

(75) Inventors: Teh C. Ho, Bridgewater, NJ (US); Stuart L. Soled, Pittstown, NJ (US); Kuangnan Qian, Belle Mead, NJ (US); Stephen J. McCarthy, Center Valley, PA (US); Andrew C. Moreland, Boerne, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 483 days.

(21) Appl. No.: 12/856,234

(22) Filed: Aug. 13, 2010

(65) Prior Publication Data

US 2011/0036755 A1 Feb. 17, 2011

Related U.S. Application Data

(60) Provisional application No. 61/274,421, filed on Aug. 17, 2009.

(51) Int. Cl.
*C10G 35/04* (2006.01)

(52) U.S. Cl.
USPC ..... 208/254 H; 208/88; 208/208 R; 208/254 R; 700/305; 702/22; 702/129

(58) Field of Classification Search
USPC ..... 208/88, 208 R, 254 H, 254 R; 700/305; 702/22–26, 129
See application file for complete search history.

(56) References Cited

U.S. PATENT DOCUMENTS 6,280,610 B1 * 8/2001 Uragami et al. ..... 208/216 R

OTHER PUBLICATIONS

Shono, Shinji; Itabashi, Kunio; Yamada, Midori; Kikuchi, Mitsuko, "Catalytic hydrogenation of organic compounds by Mo trisulfide", Kogyo Kagaku Zasshi (1961), vol. 64, pp. 1357-1361, Nihon Univ., Tokyo.

Cocchetto, Joseph F.; Satterfield, Charles N., "Thermodynamic equilibriums of selected heterocyclic nitrogen compounds with their hydrogenated derivatives", Industrial & Engineering Chemistry Process Design and Development (1976), vol. 15 (2), pp. 272-277, Dep. Chem. Eng., Massachusetts Inst. Technol., Cambridge, MA, USA.

Satterfield, Charles N.; Cocchetto, Joseph F., "Reaction network and kinetics of the vapor-phase catalytic hydrodenitrogenation of quinoline", Industrial & Engineering Chemistry Process Design and Development (1981), vol. 20 (1), pp. 53-62, Dep. Chem. Eng., Massachusetts Inst. Technol., Cambridge, MA, 02139, USA.

Gultekin, Selahattin; Al-Ohali, Mosaed S.; Al-Saleh, Muhammad A., Effects of hydrogen sulfide and water on the liquid-phase catalytic hydrodenitrogenation of quinoline. Part II: Kinetic modeling, Arabian Journal for Science and Engineering (1985), vol. 10 (3), pp. 273-280, CODEN: AJSEDY; ISSN: 0377-9211, Dep. Chem. Eng., Univ. Pet. Miner., Dhahran, Saudi Arabia.

(Continued)

*Primary Examiner* — Brian McCaig
(74) *Attorney, Agent, or Firm* — David M. Weisberg; Bruce M. Bordelon

(57) ABSTRACT

The present invention relates to a catalytic process for removing organonitrogen species from hydrocarbon mixtures such as refinery process feedstreams. More particularly, this invention relates to a new operating and catalyst loading strategies based on organonitrogen concentration, composition, and structure.

11 Claims, 1 Drawing Sheet

OTHER PUBLICATIONS

Moreau, Claude; Aubert, Claudine; Durand, Robert; Zmimita, Najib; Geneste, Patrick, Structure-activity relationships in hydroprocessing of aromatic and heteroaromatic model compounds over sulfided nickel oxide-molybdena/ .gamma.-alumina and nickel oxide-tungsten trioxide/ .gamma.-alumina catalysts: chemical evidence for the existence of two types of catalytic sites, Catalysis Today (1988), vol. 4 (1), pp. 117-131, Lab. Chim. Org. Phys. Cinet. Chim. Appl., Ec. Natl. Super. Chim. Montpellier, 34075, FR.

Hayes, Lindsey E.; Snape, Colin E.; Affrossman, Stanley, Characterization and model compound studies on palladium and nickel/molybdenum hydrous titanium oxides, Preprints of Papers—American Chemical Society, Division of Fuel Chemistry (1991), vol. 36 (4), pp. 1817-1825, Dep. Pure Appl. Chem., Univ. Strathclyde, Glasgow, G1 1XL, UK.

Boehringer, Walter; Schulz, Hans, "Comparative evaluation of elemental reactions in HDS-, HDO- and HDN-reaction networks of model compounds", Bulletin des Societes Chimiques Beiges (1991), vol. 100 (11-12), pp. 831-840, Engler-Bunte-Inst., Univ. Karlsruhe, 7500, Germany.

Ozkan, Umit, S.; Ni, Shuangyao; Zhang, Liping; Moctezuma, Edgar, "Simultaneous hydrodesulfurization and hydrodenitrogenation of model compounds over nickel-molybdenum/ .gamma.-alumina catalysts", Energy & Fuels (1994), vol. 8 (1), pp. 249-257, Dep. Chem. Eng., Ohio State Univ., Columbus, OH, 43210, USA.

Nagai, Masatoshi; Goto, Yosuke; Uchino, Osamu; Omi, Shinzo, "TPD and XRD studies of molybdenum nitride and its activity for hydrodenitrogenation of carbazole", Catalysis Today (1998), vol. 43 (3-4), pp. 249-259, Graduate School of Bio-Applications and Systems Engineering, Department of Advanced Materials, Tokyo University of Agriculture and Technology, Tokyo, 184, Japan.

Nagai, M.; Goto, Y.; Miyata, A.; Kiyoshi, M.; Hada, K; Oshikawa, K.; Omi, S., "Temperature-Programmed Reduction and XRD Studies of Ammonia-Treated Molybdenum Oxide and Its Activity for Carbazole Hydrodenitrogenation", Journal of Catalysis (1999), vol. 182 (2), pp. 292-301, Department of Advanced Materials, Graduate School of Bio-Applications and Systems Engineering, Tokyo University of Agriculture and Technology, Tokyo, 184-8588, Japan.

Cinibulk, J.; Vit, Z., "Selective Mo-Ir/A1203 sulfide catalysts for hydrodenitrogenation", Applied Catalysis, A: General (2000), vol. 204 (1), pp. 107-116, Institute of Chemical Process Fundamentals, Academy of Sciences of the Czech Republic, Prague, 165 02, Czech Rep.

Liu, Chenguang; Yu, Yingmin, Zhao, Huiji, "Hydrodenitrogenation of quinoline over Ni-Mo/A1203 catalyst modified with zinc and zirconium", Preprints—American Chemical Society, Division of Petroleum Chemistry (2003), vol. 48 (2), pp. 119-123, Key Laboratory Catalysis, CNPC, State Key Laboratory Heavy Oil Processing, College Chemistry & Chemical Engineering, Univ. Petroleum Dongying, 257061, Peop. Rep. China.

Song, Chunshan; Wang, Weilin; Wei, Boli; Oyama, S. Ted; Schwartz, Viviane, "Catalysis by Mo-based monometallic and bimetallic carbides and sulfides for simultaneous hydrodesulfurization, hydrodenitrogenation, and C-C hydrogenolysis", Preprints of Symposia—American Chemical Society, Division of Fuel Chemistry (2003), vol. 48 (1), pp. 182-184, The Energy Institute and Department of Energy & Geo-Environmental Engineering, Pennsylvania State University, University Park, PA, 16802, USA.

Turaga, Uday T.; MA, Xiaoliang; Song, Chunshan, "Influence of nitrogen compounds on deep hydrodesulfurization of 4, 6-dimethyldibenzothiophene over A1203 and MCM-41-supported Co-Mo sulfide catalysts", Catalysis Today (2003), vol. 86 (1-4), pp. 265-275, The Energy Institute, Department of Energy and Geo-Environmental Engineering, The Pennsylvania State University, University Park, PA, 16802, USA.

Liu, Chenguang; Yu, Yingmin; Zhao, Huiji, "Hydrodenitrogenation of quinoline over Ni-Mo/A1203 catalyst modified with fluorine and phosphorus", Fuel Processing Technology (2005), vol. 86 (4), pp. 449-460, Key Laboratory of Catalysis, CNPC, State Key Laboratory of Heavy Oil Processing, College of Chemistry and Chemical Engineering, University of Petroleum, Dongying, Shandong, 257061, Peop. Rep. China.

Satterfield, C.N.; Cocchetto, J.F., "The Reaction Network and Kinetics of the Vapor-Phase Catalytic Hydrodenitrogenation of Qinoline", Ind. Eng. Chem., Process Des. Dev., vol. 20 N. 1 pp. 53-62 (Jan. 1981), Mass. Inst. Technol., Cornell Univ.

Lunin, V.V.; Galafeev, V.A.; Plate, A.F., "Quinoline Hydrogenolysis Over the ZR-NI-H System", Neftekhimiya, vol. 21 N. 1, pp. 92-97 (Jan.-Feb. 1981), Mosc. State Univ.

Broderick, D.H.; Sapre, A.V.; Gates, B.C.; Kwart, H.; Schuit, G.C.A., "Hydrogenation of Aromatic Compounds Catalyzed by Sulfided COO-MOO3/ (Gamma) -A1203", J. Catal., vol. 73 N. 1, pp. 45-49 (Jan. 1982), Univ. Del.

Yeh, J.C., "Hydrodenitrogenation ( (HDN) ), Kinetic Studies of (Six) Condensed Carbocyclic N-Heterocyclic Compounds and of an SRC-II Distillate", Univ. Utah, Diss. (1985), p. 257, Univ. Utah, Diss. (1985) 257P.

Tye, C.T.; Smith, K.J., "Catalytic activity of exfoliated MoS (sub) 2 in hydrodesulfurization, hydrodenitrogenation and hydrogenation reactions", Topics in Catalysis, vol. 37/2-4, pp. 129-135, (Apr. 2006), ISSN: 1022-5528, Department of Chemical and Biological Engineering, University of British Columbia.

* cited by examiner

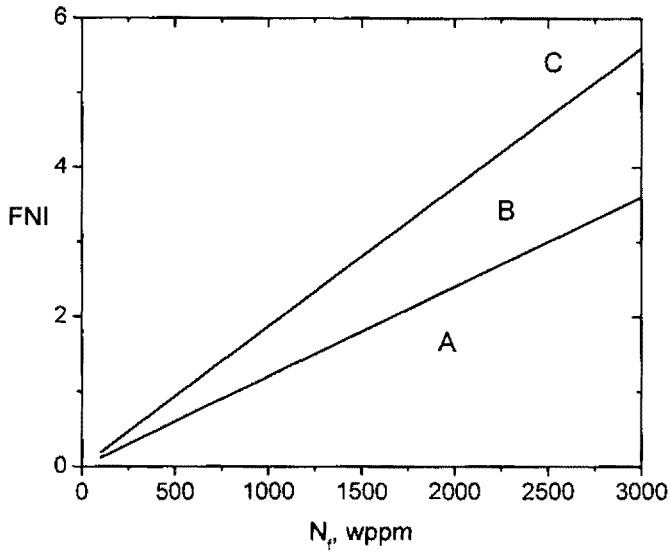
6
4
2
0
FNI
C
B
A
0
500
1000
1500
2000
2500
3000
N_f, wppm

OPERATING METHOD FOR HYDRODENITROGENATION

CROSS REFERENCE TO RELATED APPLICATION

This Application claims the benefit of U.S. Provisional Application 61/274,421 filed Aug. 17, 2009.

FIELD OF THE INVENTION

The present invention relates to a catalytic process for removing organonitrogen moieties from hydrocarbon mixtures such as refinery process feedstreams. More particularly, this invention relates to a new operating strategy for catalytic hydrodenitrogenation of feedstreams based on the relative amounts of five-membered ring nitrogen-containing heterocycles relative to six-membered ring nitrogen-containing heterocycles, as well as the total nitrogen concentration of the feedstream.

BACKGROUND OF THE INVENTION

Crude oils contain organosulfur, organonitrogen, and polynuclear aromatic (PNA) compounds, which are typically desirable to remove. These compounds are distributed in different distillate cuts at various ratios after the topping process. The heavier the distillates, the higher the level of sulfur, nitrogen, and PNA compounds, and the larger the molecules can typically be. Feedstreams that contain a high level of PNAs can tend to have a relatively low API gravity. Different catalysts and operating conditions may be required in order to achieve predetermined processing objectives.

Catalytic hydroprocessing is an important process in the petroleum refining industry. The purpose of hydroprocessing can vary depending on the feedstream and operating conditions. For example, some objectives can include the improvement of feed quality, abatement of air pollution, the protection of downstream catalysts, and the like. One type of catalytic hydroprocessing is catalytic hydrodenitrogenation (HDN) which involves the removal of nitrogen atoms from organonitrogen compounds. This generally includes hydrogenation of the nitrogen compounds followed by C—N bond cleavage. Thus, the catalyst should generally be able to perform at least two functions, namely hydrogenation and hydrogenolysis. An active HDN catalyst generally balances these two functionalities. The HDN reaction tends to proceed relatively fast with lower boiling feedstreams, but tends to become much slower as the boiling range of the feedstream increases. With higher boiling range feedstreams, e.g., heavy vacuum gas oils and residua, HDN can become more difficult, and complete HDN may not be obtained, even at relatively high severity conditions over the best of present commercially available catalysts. One reason for this can be that heavy heterocyclic nitrogen compounds are generally rather unreactive (or refractory). Another reason can be that intermediate (hydrogenation) reactions can occur that may lead to the formation of nitrogen-containing intermediate species that are more self inhibiting than the parent nitrogen compound. Such HDN intermediates may also inhibit the nitrogen removal of the parent compounds. Further, additional hydrogen would then be consumed to achieve a satisfactory HDN level, and the reaction may also be limited by thermodynamic equilibrium, as the reactor temperature is raised to compensate for catalyst deactivation. Prior hydrogenation of non-nitrogen containing species in the feedstreams (such as arene, aryl, and aromatic ring, or rings, particularly those adjacent to, and adjoined via a nuclear or ring carbon atom with the nitrogen atom to be denitrogenated) may be necessary to achieve a satisfactory level of nitrogen removal. Moreover, at conditions utilized for satisfactory nitrogen removal, other non-nitrogen containing aromatic and/or other unsaturated molecules can also simultaneously be hydrogenated, which can further increase hydrogen consumption over that which is necessary for stoichiometric nitrogen removal.

The following reactions have been found to occur during hydrodenitrogenation of model compounds: (1) HDN of aromatic amines and polyamines (e.g., aniline); (2) HDN of five-membered ring heterocyclic nitrogen species (such as indole and carbazole type compounds), with or without alkyl substituents; and (3) HDN of six-membered ring heterocyclic species (such as quinoline and acridine type compounds), with or without alkyl substituents.

While there are presently commercial processes for removing multi-ring nitrogen heterocycles from hydrocarbon streams, there remains a need in the art for processes that are more efficient and effective through the determination and quantification of the relative concentrations of five- and six-membered nitrogen heterocycles in refinery process feedstreams.

SUMMARY OF THE INVENTION

In accordance with the present invention, there is provided a process for the hydrodenitrogenation of a liquid hydrocarbon feedstream in a reactor having a reactor volume in the presence of a catalyst comprising at least one Group VIII metal and at least one Group VIB metal, which feedstream has a boiling range of about 200° C. to about 550° C. and having a total nitrogen heteroatom concentration, denoted by $N_f$, ranging from about 10 wppm to about 3000 wppm (in the form of both five-membered and six-membered ring nitrogen-containing heterocycles), which process comprises:

a) measuring a total nitrogen concentration in the feedstream, $N_f$, in units of wppm, and an amount of nitrogen atoms in five-membered ring nitrogen-containing heterocycles and in six-membered ring nitrogen-containing heterocycles in the feedstream, which are in units of wppm based on the total weight of the feedstream;

b) calculating the feed nitrogen factor as $f_n=X/(X+Y)$, where X is the concentration of nitrogen atoms in five-membered ring nitrogen-containing heterocycles in the feedstream and where Y is the concentration of nitrogen atoms in six-membered ring nitrogen-containing heterocycles in the feedstream;

c) incorporating the results into the following formula and determining the feed nitrogen index, FNI, where $$FNI = \frac{N_f}{300} f_n^2;$$

d) locating the FNI on a plot of FNI vs. $N_f$ that is divided into three regions labeled A, B, and C, wherein region A is defined by the inequality $FNI<0.0012\ N_f$ such that $f_n<0.60$, wherein region C is defined by the inequality $FNI>0.0019\ N_f$ such that $f_n>0.75$, and wherein region B is defined by the inequality $0.0012\ N_f \leqq FNI \leqq 0.0019\ N_f$ such that $0.6 \leqq f_n \leqq 0.75$; and e) determining a hydrogen treat gas rate, $TGR_v$, corresponding to the onset of complete vaporization of the feedstream at prevailing reactor conditions, and wherein when FNI lies in i) Region C, adjusting the hydrotreating process by one or more of: (1) running at a hydrogen treat gas rate that is greater than about 0.3 $TGR_v$; (2) using a bulk metal sulfide catalyst containing Ni, Co, Mo, and/or W; (3) placing a bulk catalyst downstream of a supported catalyst in a stacked bed, with the bulk catalyst occupying more than about 15% of the reactor volume; (4) placing a bulk catalyst in between two supported catalysts in a stacked bed, with the bulk catalyst occupying more than about 15% of the reactor volume; (5) using W as the at least one Group VIB metal; (6) using both W and Mo as the at least one Group VIB metal; and (7) using Ni as the at least one Group VIII metal;

ii) Region B, adjusting the hydrotreating process by one or more of: (1) running at a hydrogen treat gas rate that is greater than about 0.2 $TGR_v$; (2) placing a bulk catalyst downstream of a supported catalyst in a stacked bed, with the bulk catalyst occupying more than about 10% of the reactor volume; (3) placing a bulk catalyst in between two supported catalysts in a stacked bed, with the bulk catalyst occupying more than about 10% of the reactor volume; (4) loading the reactor with only a supported catalyst; (5) using both W and Mo as the at least one Group VIB metal; and (6) using Ni as the at least one Group VIII metal; and iii) Region A, adjusting the hydrotreating process by one or more of: (1) running at a hydrogen treat gas rate that is greater than about 0.05 $TGR_v$; (2) placing a bulk catalyst downstream of a supported catalyst in a stacked bed, with the bulk catalyst occupying more than about 5% of the reactor volume; (3) placing a bulk catalyst in between two supported catalysts in a stacked bed, with the bulk catalyst occupying more than about 5% of the reactor volume; (4) loading the reactor with only a supported catalyst; (5) using both W and Mo as the at least one Group VIB metal; and (6) using Ni or Co as the at least one Group VIII metal.

BRIEF DESCRIPTION OF THE FIGURE

FIG. 1 is a plot of Feed Nitrogen Index (FNI) versus total heteroatom nitrogen concentration ($N_f$); the three regions A, B, and C were generated using the formulae delineated herein.

DETAILED DESCRIPTION OF THE PREFERRED EMBODIMENTS

Feedstreams on which the present invention can be practiced can preferably be those refinery process feedstreams boiling in the range of about 200° C. to about 550° C., such as middle distillates (about 200° C. to about 350° C.) and gas oils (about 350° C. to about 550° C.). Such feedstreams (including heating oil, diesel fuel and kerosene) can contain a substantial amount of nitrogen, e.g., at least about 10 wppm nitrogen, and sometimes greater than about 1000 wppm, in the form of organonitrogen compounds. The feedstreams can also contain a significant sulfur content, typically ranging from about 0.1 wt % to about 3 wt % or higher.

The present invention allows for improvement and/or optimization of a hydrodenitrogenation catalyst system and/or process, depending on the relative amounts of 5-membered and 6-membered ring nitrogen-containing compounds in the feedstream. Typical HDN temperatures can range from about 100° C. to about 400° C. at pressures from about 50 psig to about 3000 psig, preferably at pressures from about 100 psig to about 2000 psig, for example at pressures from about 200 psig to about 1200 psig. Preferred hydrogen partial pressures can be from about 400 psig to about 1000 psig, for example from about 500 psig to about 800 psig.

Suitable HDN catalysts for use in the present invention can include conventional HDN catalysts and particularly those that comprise at least one Group VIII metal, preferably Fe, Co, and/or Ni, such as Co and/or Ni; and at least one Group VIB metal, preferably Mo and/or W. Some widely used HDN catalysts include transition metal sulfides that are impregnated or dispersed on a refractory support or carrier such as alumina and/or silica. The support or carrier itself typically has no significant/measurable catalytic activity. Carrier- or support-free catalysts, commonly referred to as bulk catalysts (which may nevertheless include low levels of carrier or support materials as contaminants from other catalyst ingredients), generally have higher volumetric activities than their supported counterparts. The catalysts used in the present invention can be either in bulk form or in supported form. In addition to alumina and/or silica, other suitable support/carrier materials can include, but are not limited to, zeolites, titania, silica-titania, and titania-alumina. It is within the scope of the present invention that more than one type of hydroprocessing catalyst can be used in one or multiple reaction vessels. The at least one Group VIII metal, in oxide form, can typically be present in an amount ranging from about 2 wt % to about 20 wt %, preferably from about 4 wt % to about 12 wt %. The at least one Group VIB metal, in oxide form, can typically be present in an amount ranging from about 5 wt % to about 80 wt %, preferably from about 10 wt % to about 60 wt % or from about 20 wt % to about 30 wt %. These weight percents are based on the total weight of the catalyst.

An HDN process can generally include selection of (i) an effective amount of an HDN catalyst comprising at least one Group VIII metal and at least one Group VIB metal, (ii) an appropriate startup operating temperature (or temperature range) T, (iii) a sufficient operating hydrogen partial pressure (or pressure range) P, (iv) a suitable liquid hourly space velocity LHSV (or LHSV range), and (v) a suitable hydrogen treat gas rate (or treat gas rate range) TGR. To improve and/or optimize the performance of the HDN process for a given catalyst or catalyst system, the refiner generally has at least four operating levers: temperature (T), hydrogen partial pressure (P), LHSV, and hydrogen treat gas rate (TGR). Within the hardware constraints of the reactor, an HDN catalytic process can be designed within a subspace of the space spanned by these four operating levers. The subspace may be called the global operating space defined by $T_{min} \leqq T \leqq T_{max}$, $P_{min} \leqq P \leqq P_{max}$, $LHSV_{min} \leqq LHSV \leqq LHSV_{max}$, and $TGR_{min} \leqq TGR \leqq TGR_{max}$. The subscripts can be understood by noting that $T_{min}$ and $T_{max}$ are the minimum and maximum permissible temperatures. In practice, the actual operating space can be a subspace of the global operating space and can depend, inter alia, on the feedstream properties and the particular catalyst or catalyst system.

The present invention can stretch the efficiency of a hydrodenitrogenation process by tweaking the actual operating space through more effectively matching feedstream nitrogen concentration and composition with catalyst and operating conditions. Of particular note is the fact that the present invention teaches how to further improve the efficiency of hydroprocessing by taking advantage of recent advances in analytical techniques that now make it more feasible to perform molecular speciation analyses on petroleum fractions relatively quickly. One such example is electrospray ionization mass spectrometry (ESI-MS), which can detect trace (e.g., single digit ppm) levels of polar species in a petroleum fraction. When the ESI is operated in positive ion mode, it can selectively ionize species that can be easily protonated, such as six-membered ring nitrogen heterocyclic compounds (e.g., acridine). In negative ion mode, it can selectively ionize species that can be easily deprotonated, such as five-membered ring nitrogen heterocyclic compounds (e.g., carbazole). Comparative or calibrated results can be obtained using acridine and carbazole as internal standards.

One preferred mass spectrometer that can be used in the practice of the present invention is the Waters Quattro II™ tandem quadrupole mass spectrometry system, preferably equipped with an electrospray ionization apparatus such as an Advion NanoMate 100™ that can be based on a 96-well sample introduction with a silicon chip containing 100-400 nozzles. Typical conditions for ESI-MS may be as follows: nozzle voltage of about 1.5-1.75 kV; delivering pressure of about 0.15-0.20 psi; mass range of about m/z 70-1000; scan speed of about 3 s/scan; resolution of about unit mass resolution; cone voltage ramped from about 20 V to about 70 V as mass scanned from about 70 amu to about 1000 amu; and extraction voltage of about 3-25 V.

Very difficult-to-denitrogenate nitrogen-containing compounds include those whose aromaticity is relatively high, particularly where the nitrogen heteroatom(s) is(are) incorporated in the ring (e.g., quinolines, carbazoles, phenanthroline). Hence, two important reactions involved in HDN include hydrogenation of aromatic rings and the hydrogenolytic cleavage of C—N bonds. The present invention generally involves the following three elements: (a) the total concentration of nitrogen (atoms) in the process feedstream, (b) the relative amounts of nitrogen in five-membered and six membered ring nitrogen-containing heterocycles; and (c) the use of a catalyst system comprising two functionalities, namely hydrogenation and hydrogenolysis. Improvement/Optimization of the HDN catalyst system and process parameters can be adaptively adjusted by the Feed Nitrogen Index, represented as $FNI=(N_f/300)f_n^2$, wherein $N_f$ is feedstock nitrogen atom concentration (in wppm) and wherein $f_n=X/(X+Y)$, with X being the concentration (e.g., wppm) of nitrogen atoms associated with five-membered ring nitrogen-containing heterocycles in the feedstream and Y being the concentration (e.g., wppm) of nitrogen atoms associated with six-membered ring nitrogen-containing heterocycles in the feedstream.

Based on ESI-MS measurements and hydrotreating experiments, on a relative basis, feedstreams with $f_n$ values greater than 0.75 can be classified as relatively-difficult-to-denitrogenate feeds, while those with $f_n$ values less than 0.6 can be classified as relatively-easy-to-denitrogenate feeds. Besides the $f_n$ value, the total feedstream nitrogen content, $N_f$, is also an important factor. Using these $f_n$ and $N_f$ values and the formula for FNI, an FNI vs. $N_f$ plot can be generated, e.g., as shown in FIG. 1. This plot divides the FNI-$N_f$ plane into three regions that characterizes the denitrogenation difficulty of the feedstreams. As such, region A is defined by the inequality $FNI<0.0012\ N_f$ such that $f_n<0.60$; region C is defined by the inequality $FNI>0.0019\ N_f$ such that $f_n>0.75$; and region B is defined by the inequality $0.0012\ N_f \leqq FNI \leqq 0.0019\ N_f$ such that $0.6 \leqq f_n \leqq 0.75$.

Referring to FIG. 1, when FNI lies in region C, the hydrotreating process can be adjusted by one or more of: (1) running at a hydrogen treat gas rate that is greater than 0.3 $TGR_v$, for example greater than 0.45 $TGR_v$ or preferably greater than 0.5 $TGR_v$; (2) using a bulk metal sulfide catalyst containing Ni, Co, Mo, and/or W; (3) placing a bulk catalyst downstream of a supported catalyst in a stacked bed, with the bulk catalyst occupying more than 15% of the reactor volume, for example more than about 20% of the reactor volume or preferably more than about 25% of the reactor volume; (4) placing a bulk catalyst in between two supported catalysts in a stacked bed, with the bulk catalyst occupying more than 15% of the reactor volume, for example more than about 20% of the reactor volume or preferably more than about 25% of the reactor volume; (5) using W as the at least one Group VIB metal; (6) using both W and Mo as the at least one Group VIB metal; and (7) using Ni as the at least one Group VIII metal.

Additionally or alternately, when FNI lies in region B, the hydrotreating process can be adjusted by one or more of: (1) running at a hydrogen treat gas rate that is greater than 0.2 $TGR_v$, for example greater than 0.3 $TGR_v$, or preferably greater than 0.4 $TGR_v$; (2) placing a bulk catalyst downstream of a supported catalyst in a stacked bed, with the bulk catalyst occupying more than about 10% of the reactor volume, for example more than about 15% of the reactor volume or preferably more than about 20% of the reactor volume; (3) placing a bulk catalyst in between two supported catalysts in a stacked bed, with the bulk catalyst occupying more than about 10% of the reactor volume, for example more than about 15% of the reactor volume or preferably more than about 20% of the reactor volume; (4) loading the reactor with only a supported catalyst; (5) using both W and Mo as the at least one Group VIB metal; and (6) using Ni as the at least one Group VIII metal.

Additionally or alternately, when FNI lies in region A, the hydrotreating process can be adjusted by one or more of: (1) running at a hydrogen treat gas rate that is greater than about 0.05 $TGR_v$, for example greater than 0.15 $TGR_v$, or preferably greater than 0.3 $TGR_v$; (2) placing a bulk catalyst downstream of a supported catalyst in a stacked bed, with the bulk catalyst occupying more than about 5% of the reactor volume, for example more than about 10% of the reactor volume or preferably more than about 15% of the reactor volume; (3) placing a bulk catalyst in between two supported catalysts in a stacked bed, with the bulk catalyst occupying more than about 5% of the reactor volume, for example more than about 10% of the reactor volume or preferably more than about 15% of the reactor volume; (4) loading the reactor with only a supported catalyst; (5) using both W and Mo as the at least one Group VIB metal; and (6) using Ni or Co as the at least one Group VIII metal.

In the case where FNI lands on any line separating regions of the FIGURE herein, usually the refiner can have a wider operating window by choosing to operate in either region. That is, if the FNI falls on the line separating regions A and B, then the refiner can choose options for either region, or a combination of options for both regions. However, this specification has assumed that, when FNI falls on any line separating regions of the FIGURE, the options for region B have been applied, but only to remove ambiguity in choosing options.

The options listed above are for refiners to consider. It should be understood that the process configurations and associated facilities can vary greatly among different refineries. Depending on the local economics and hardware constraints, inter alia, the refiner may exercise only one or a small subset of the above options. For instance, the refiner may decide to increase TGR by adjusting hydrogen recycle rate or hydrogen makeup rate. Additionally or alternatively, the refiner may opt to use a relatively high activity bulk catalyst. In this latter situation, the bulk catalyst may be used in a stacked or sandwiched bed (wherein the bulk catalyst can be placed between two supported catalysts), depending on various considerations including, but not limited to, product quality, control of reaction exothermicity, and the like. Note that refiners may periodically need to run feedstocks rich in unsaturated hydrocarbons, and, for such feedstocks, control and management of the resulting highly exothermic reactions can be vitally important.

What is claimed is:

1. A process for the hydrodenitrogenation of a liquid hydrocarbon feedstream in a reactor having a reactor volume in the presence of a catalyst comprising at least one Group VIII metal and at least one Group VIB metal, which feedstream has a boiling range of about 200° C. to about 550° C. and having a total nitrogen heteroatom concentration, denoted by $N_f$, ranging from about 10 wppm to about 3000 wppm, which process comprises:

a) measuring a total nitrogen concentration in the feedstream, $N_f$, in units of wppm, and an amount of nitrogen atoms in five-membered ring nitrogen-containing heterocycles and in six-membered ring nitrogen-containing heterocycles in the feedstream, which are in units of wppm based on the total weight of the feedstream;

b) calculating the feed nitrogen factor as $f_n=X/(X+Y)$, where X is the concentration of nitrogen atoms in five-membered ring nitrogen-containing heterocycles in the feedstream and where Y is the concentration of nitrogen atoms in six-membered ring nitrogen-containing heterocycles in the feedstream;

c) incorporating the results into the following formula and determining the feed nitrogen index, FNI, where $$FNI = \frac{N_f}{300} f_n^2;$$

d) locating the FNI on a plot of FNI vs. $N_f$ that is divided into three regions labeled A, B, and C, wherein region A is defined by the inequality $FNI<0.0012\ N_f$ such that $f_n<0.60$, wherein region C is defined by the inequality $FNI>0.0019\ N_f$ such that $f_n>0.75$, and wherein region B is defined by the inequality $0.0012\ N_f \leqq FNI \leqq 0.0019\ N_f$ such that $0.6 \leqq f_n \leqq 0.75$; and e) determining a hydrogen treat gas rate, $TGR_v$, corresponding to the onset of complete vaporization of the feedstream at prevailing reactor conditions, and wherein when FNI lies in (i) region C, adjusting the hydrotreating process by one or more of: (1) running at a hydrogen treat gas rate that is greater than about 0.3 $TGR_v$; (2) using a bulk metal sulfide catalyst containing Ni, Co, Mo, and/or W; (3) placing a bulk catalyst downstream of a supported catalyst in a stacked bed, with the bulk catalyst occupying more than about 15% of the reactor volume; (4) placing a bulk catalyst in between two supported catalysts in a stacked bed, with the bulk catalyst occupying more than about 10% of the reactor volume; (5) using W as the at least one Group VIB metal; (6) using both W and Mo as the at least one Group VIP metal; and (7) using Ni as the at least one Group VIII metal;

(ii) region B, adjusting the hydrotreating process by one or more of: (1) running at a hydrogen treat gas rate that is greater than about 0.2 $TGR_v$; (2) placing a bulk catalyst downstream of a supported catalyst in a stacked bed, with the bulk catalyst occupying more than about 10% of the reactor volume; (3) placing a bulk catalyst in between two supported catalysts in a stacked bed, with the bulk catalyst occupying more than about 10% of the reactor volume; (4) loading the reactor with only a supported catalyst; (5) using both W and Mo as the at least one Group VIB metal; and (6) using Ni as the at least one Group VIII metal; and (iii) region A, adjusting the hydrotreating process by one or more of: (1) running at a hydrogen treat gas rate that is greater than about 0.05 $TGR_v$; (2) placing a bulk catalyst downstream of a supported catalyst in a stacked bed, with the bulk catalyst occupying more than about 5% of the reactor volume; (3) placing a bulk catalyst in between two supported catalysts in a stacked bed, with the bulk catalyst occupying more than about 5% of the reactor volume; (4) loading the reactor with only a supported catalyst; (5) using both W and Mo as the at least one Group VIB metal; and (6) using Ni or Co as the at least one Group VIII metal.

2. The process of claim 1, wherein the feedstream is a middle distillate having a boiling range from about 200° C. to about 350° C.

3. The process of claim 1, wherein the feedstream is a gas oil having a boiling range from about 350° C. to about 550° C.

4. The process of claim 1, wherein the prevailing reactor conditions comprise a temperature from about 100° C. to about 400° C.

5. The process of claim 1, wherein the prevailing reactor conditions comprise a reactor pressure from about 50 psig to about 3000 psig. The process of claim 5, wherein the reactor pressure is from about 100 psig to about 2000 psig.

6. The process of claim 1, wherein the prevailing reactor conditions comprise a hydrogen partial pressure from about 400 psig to about 1000 psig.

7. The process of claim 6, wherein the hydrogen partial pressure is from about 500 psig to about 800 psig.

8. The process of claim 1, wherein the hydrogen treat gas rate can be greater than about 0.45 $TGR_v$ for region C, greater than about 0.3 $TGR_v$ for region B, and greater than about 0.15 $TGR_v$ for region A.

9. The process of claim 8, wherein the hydrogen treat gas rate can be greater than about 0.5 TGR, for region C, greater than about 0.4 TGR, for region B, and greater than about 0.3 TGR, for region A.

10. The process of claim 1, wherein the bulk catalyst occupies more than about 20% of the reactor volume for region C, more than about 15% of the reactor volume for region B, and more than about 10% of the reactor volume for region A.

11. The process of claim 10, wherein the bulk catalyst occupies more than about 25% of the reactor volume for region C, more than about 20% of the reactor volume for region B, and more than about 15% of the reactor volume for region A.

* * * * *